US005972396A

United States Patent [19]

Jurgovan et al.

[11] Patent Number: 5,972,396

[45] Date of Patent: Oct. 26, 1999

[54] FLEXIBLE PACKAGE HAVING A RE-CLOSABLE ZIPPER

[75] Inventors: Marc A. Jurgovan, Plano; Martin B. Dierl, Allen, both of Tex.

[73] Assignee: Recot, Inc., Pleasanton, Calif.

[21] Appl. No.: 09/079,382

[22] Filed: May 15, 1998

[51] Int. Cl.[6] ..... B65D 85/00; B65D 33/16

[52] U.S. Cl. ..... 426/106; 426/127; 206/810; 383/61; 383/63

[58] Field of Search ..... 426/106, 127, 426/410; 206/807, 810; 383/61, 63, 210

[56] References Cited

U.S. PATENT DOCUMENTS

| | | | |
|---|---|---|---|
| 4,925,316 | 5/1990 | Van Erden et al. | 383/61 |
| 5,224,779 | 7/1993 | Thompson et al. | 383/5 |
| 5,242,516 | 9/1993 | Custer et al. | 156/66 |
| 5,749,658 | 5/1998 | Kettner et al. | 383/204 |

*Primary Examiner*—David Lacey
*Assistant Examiner*—Drew Becker
*Attorney, Agent, or Firm*—Rothwell, Figg, Ernst & Kurz

[57] ABSTRACT

A modified flexible package includes a front elastomeric wall and a rear elastomeric wall. The front wall and the rear wall are sealed together at a top seal at a top end of the side walls. The top seal is formed by applying heat and/or pressure for a given dwell period, and is preferably a de-laminating seal. A first zipper part is attached to an inside surface of the front wall and has a first engagement member facing the rear wall. A second zipper part is attached to an inside surface of the rear wall and has a second engagement member facing the front wall. The first and second engagement members are engaged together. Both the top seal and the zipper engagement members are "pinch-grip opened" under a pinch-grip pulling force applied to the front and rear walls below the zipper. The front and rear walls have a strength sufficient to resist tearing and deformation under the application of the pinch-grip pulling force during pinch-grip opening. The invention provides a re-closable package that can be opened in an easy one-step manner—"pinch grip opening"—without an additional step of cutting, tearing or the like.

31 Claims, 7 Drawing Sheets

FLEXIBLE PACKAGE HAVING A RE-CLOSABLE ZIPPER

BACKGROUND OF THE INVENTION

1. Field of the Invention

The present invention relates to flexible packages having means for selectively re-closing the packages after their initial opening. Most particularly, the present invention provides a unique re-closable flexible package that is highly consumer-friendly—especially with snack foods such as potato chips, corn chips and the like.

2. Description of the Related Art

The present invention is an improvement over existing flexible packages, including those currently used by the present assignee for containing snack foods such as Lays® potato chips, Tostitos® tortilla chips and the like. Packages for such products usually have top and bottom end seals that are formed by heat sealing and are opened by "pinch gripping" (see FIG. 1) the sides of the package and pulling outward to break the end seal for access therein. These common packages, however, do not contain means to re-close the package after the initial opening of the end seals. Because the heat seal has been destroyed, the most common way of re-closing the package is to fold-over the open end and apply a clip to secure the folded portion.

Flexible packages having re-closable zippers are known in certain applications. A variety of food products can be purchased in pre-sealed flexible packages having re-closable zippers for re-closing the food product after the initial opening.

Although a number of packages with re-closable zippers are known, the existing packages have a number of drawbacks. For example, these prior packages typically must be initially opened using two distinct steps. First, a heat seal must be broken by cutting the package with scissors or by removing a tear-away, perforated strip. The re-closable zipper closure is then opened in a distinct second step. This substantially reduces the consumer appeal of the packages and makes the packages undesirable for a variety of products, such as for snack food chips and the like.

A preferred process of packaging snack food products, such as potato chips, tortilla chips and the like, inside plastic flexible packages is known in the art as a "vertical form/fill/seal process." In this process, as seen in FIG. 9, a length of plastic film F is formed into a vertical tube T around a product delivery cylinder C, the food product is delivered into the vertical tube through the cylinder, the vertical tube is vertically sealed along its length to form a back seal 50 and is transversely sealed to form top and bottom seals delineating individual packages, and the individual packages are cut from the vertical tube.

Providing a zipper closure to a package in a vertical form/fill/seal apparatus presents a number of difficulties. Typically, in non-vertical form/fill/seal apparatuses, a zipper is attached to an elongated moving plastic film lengthwise to the direction of travel of the film. To attach a zipper to a package in a vertical form/fill/seal apparatus, however, the zipper must be attached to the film transverse to the travel direction of the film, in order to create a package with a zipper sealed near the top end of the package.

U.S. Pat. No. 4,909,017 (assigned to Minigrip, Inc.), the entire disclosure of which is incorporated herein by reference, shows a vertical form fill process which fills product into a reclosable package having a zipper or fastener portion 34 and a pilfer-evident seal 35 above the fastener. In summary, a film is fed over shaping shoulders 21 and around a vertical forming and filling tube 24. Welding bars 22 and 23 seal edges of the film together to form a tube with a vertical seam. Welding bars 27 and 28 form a lower seal 29, and product is dropped into the vertical tube 24. The fastener strips slide over the tube 24 with only one part fixed to one side of the film tube. The fastener strips are later sealed to both sides of the film by the bars 27 and 28.

As noted on col. 4, lines 29–31, "[the] seam [35] is a pilfer-evident closure for the package and the seam can be removed cut off [sic] the tip of the package before the package is to be used." Thus, the packages require a distinct two-step opening process.

U.S. Pat. No. 4,617,683, (assigned to Minigrip, Inc.), shows another vertical form fill process which fills product into a reclosable package having a top seal 42 and a reclosable zipper or fastener 27 inside of the package. As noted on col. 6, lines 30, et seq., > [i]n the finished fully sealed package[,] the profiles 52 may remain separated as shown in FIG. 2 until the top end or mouth of the package has been opened as shown in FIG. 3 for access to contents in the package, and then the package can be closed by interengagement of the fastener profiles as shown in FIG. 3. Opening of the package may be effected either by pulling the seal at the top end of the package open, or by severing the top end of the package along a line 58 between the seal 42 and the reclosable fastener 27 . . .

(emphasis added). Among other disadvantages of the '683 patent, when the top end of the package must be severed to be opened, as noted above, this greatly inhibits consumer-friendliness of the packages. Another disadvantage of the '683 patent is that the initial separation of the profiles 52 (see FIG. 2) creates difficulties in the proper placement and alignment of the fastener halves on the film (e.g., in attaching fastener halves they must align at appropriate positions with respect to one another to ensure engagement). Connecting the fastener halves after the formation of the packages can thus lead to substantial alignment problems. It is notable that the '683 patent thus includes a plurality of parallel fastener profiles. (see col. 6, lines 25–29: "By having a plurality of the parallel fastener profiles 52, interengagement of the profiles of the folded section is facilitated since critical lateral alignment is not necessary.") Another disadvantage of the '683 patent is that during manufacture, the fastener halves must be conveyed individually along with the film (e.g., must each be attached thereto); however, if the fastener halves are interlocked, one half can be attached and the other half can be carried thereon. Another disadvantage is that the fastener is exposed to the product during transport such that product can become lodged in the fastener and interfere with the operation thereof (e.g., if the package is inverted or for some reason held topside down during shipping, crumbs, etc., can accumulate within the valleys of the fastener portions).

Other known methods, apparatuses and packages illustrative of the background art of the present invention are seen for example in U.S. Pat. Nos.: 5,558,613 (assigned to Minigrip, Inc.); 5,557,907 and 5,592,802 (assigned to Illinois Tool Works, Inc.); 4,925,316 (assigned to Minigrip, Inc.); 4,709,398 (assigned to Minigrip, Inc.); 4,691, 372 (assigned to Minigrip, Inc.); 5,330,269 (assigned to Toyo Aluminum Kabushiki Kaisha); 5,067,822 (assigned to Reynolds Consumer Products, Inc.); 4,782,951 (assigned to Oscar Mayer Foods Corp.); and 4,976,811 (assigned to Com-Pac International, Inc.

SUMMARY OF THE INVENTION

According to one aspect of the invention, a flexible package is produced which can be opened in a manner like common Frito-Lay, Inc., snack food packages, wherein the packages are "pinch-gripped" at opposite sides and pulled apart to open (see FIG. 1). Thus, the packages, both initially and throughout use, are opened in one simple step.

According to another aspect of the invention, a package is produced having both 1) a heat and/or pressure formed (preferably de-laminating) top seal and 2) a re-closable zipper, wherein both the top seal and the zipper are opened when a user opens a package with a simple "pinch-grip" opening method.

According to another aspect of the invention, 1) a vertical form fill process is used to quickly and efficiently package food product, 2) a re-closable zipper is attached to the package during the vertical form fill process, and 3) a user-friendly pinch-grip open package is produced. The method and apparatus can, thus, be easily adapted to large scale packaging operations.

According to one aspect of the invention, a flexible package is provided having a elastomeric front wall and an elastomeric rear wall; the front wall and the rear wall being sealed together at a top seal; a first zipper part attached to an inside surface of the front wall and having a first engagement member facing the rear wall; a second zipper part attached to an inside surface of the rear wall and having a second engagement member facing the front wall; the first and second engagement members being engaged together; the top seal being manually pinch-grip openable and the first and second engagement members being manually pinch-grip openable under a pinch-grip pulling force applied to the front and rear walls below the engagement members; the front and rear walls having a sufficient strength to resist tearing and deformation under the application of the pinch-grip pulling force during pinch-grip opening; and b) a food product stored inside the package below the first and second engagement members.

The terminology front and rear walls refers to opposing front and rear sides and encompasses separate wall members that are attached together (e.g., by one or more seams), wall members that are integrally formed, e.g., extruded together, etc. In this regard, although some of the preferred embodiments involve packages that are constructed from a single elongated sheet that is formed into a tube having front and rear walls by sealing along a back-seal, such a plastic tube could also, in one alternative embodiment, be formed by extruding an elongated tube.

According to another aspect of the invention, the top seal is a heat/pressure/dwell seal (defined herein-below). For example, the top seal can be formed by heat and pressure for a given dwell period. As another example, the top seal can be formed by pressure, without heat, for a given dwell period.

According to another aspect of the invention, the first engagement member has a male protrusion and the second engagement member has at least one protrusion forming a female socket, the male protrusion being engaged in the female socket.

According to another aspect of the invention, the front and rear walls are laminated plastic walls including at least one inner sealable layer and at least one outer wall layer.

According to another aspect of the invention, the first and second zipper parts have cross-sectional shapes that are different from one another and are separate pieces that are connected together only at the engagement members. Although less preferred, the zipper parts can each have the same cross-sectional shape.

According to another aspect of the invention, the package includes a food product therein. Most preferably, the food product includes salty, sweet or savory snack foods, which are known in the art as providing salty, sweet or savory tastes, such as for example certain snack foods containing salt, sugar, etc.

According to another aspect of the invention, a flexible package is provided having: front and rear walls, the front and rear walls being laminated plastic walls including at least one inner sealable layer and at least one outer wall layer; a bottom seal formed between lower sides of the front and rear walls; a top seal formed between upper sides of the front and rear walls, the top seal including a seal between the inner sealable layers; a zipper located within the package proximate the top seal, the zipper having a first zipper part having a first engagement member extending lengthwise along the zipper part and a widened base having at least two points of sealant behind the base; the zipper also having a second zipper part having a second engagement member extending lengthwise along the zipper part and a widened base having at least two points of sealant behind the base; the first engagement member being engaged with the second engagement member; the at least two points of sealant on the first zipper part being sealed to the inner layer of the film at a first side of the vertical tube and the at least two points of sealant on the second zipper part being sealed to the inner layer of the film at a second side of the vertical tube; the seal between the inner sealable layers being openable by de-lamination and the engagement between the engagement members of the zipper being disengaged upon the application of a predetermined pinch-grip pulling force.

According to another aspect of the invention, a method of opening and re-closing a flexible package containing a food product is provided which includes the steps of: 1) providing in combination: a) a flexible package having a elastomeric front wall and an elastomeric rear wall; the front wall and the rear wall being sealed together at a top seal; a first zipper part attached to an inside surface of the front wall and having a first engagement member facing the rear wall; a second zipper part attached to an inside surface of the rear wall and having a second engagement member facing the front wall; the first and second engagement members being engaged together; the top seal and the first and second engagement members being pinch-grip openable under a pinch-grip pulling force applied to the front and rear walls below the engagement members; the front and rear walls having a sufficient strength to resist tearing and deformation under the application of the pinch-grip pulling force during pinch-grip opening; and b) a food product stored inside the package below the first and second engagement members; 2) pinch-grip opening the package by manually pulling with a force of at least the pinch-grip pulling force opposite sides of the package below the zipper to open both the zipper, by disengaging the engagement portions, and the upper seal from the product side outward in a single pinch-grip opening step; 3) removing a portion of the food product from the package; 4) re-closing the package by manually re-engaging the first and second engagement members. According to another aspect of the invention, during the single step of pinch-grip opening, the zipper is at least partially disengaged before the top seal begins to open.

ADVANTAGES OF THE PRESENT INVENTION

The present invention has a number of significant advantages over the prior art. For example, the present invention provides a package having both a top end seal and a zipper that are both closed during transportation and handling of the product, whereby a) the quality and durability of the seal is enhanced, b) food particles are inhibited from interfering with the zipper fastener, and c) a vertical form/fill/seal process like that of U.S. Pat. No. 4,909,017 can be utilized to package product.

In addition, the present invention also provides a re-closable package that a consumer can open in a simple one-step process—rather than an awkward two-step process requiring scissors or the like. The re-closable packages of the present invention can be opened using a "pinch grip" method commonly used to open existing snack food packages. It is thus not necessary to educate consumers on how to use the packages. The packages are thus very consumer friendly.

The above and other advantages, features and aspects of the present invention will be more readily perceived from the following description of the preferred embodiments taken together with the accompanying drawings and claims.

BRIEF DESCRIPTION OF THE DRAWINGS

The present invention is illustrated by way of example and not limitation in the accompanying drawings, in which like references indicate like parts, and in which.

DETAILED DESCRIPTION OF THE PREFERRED EMBODIMENTS

Figure 1:
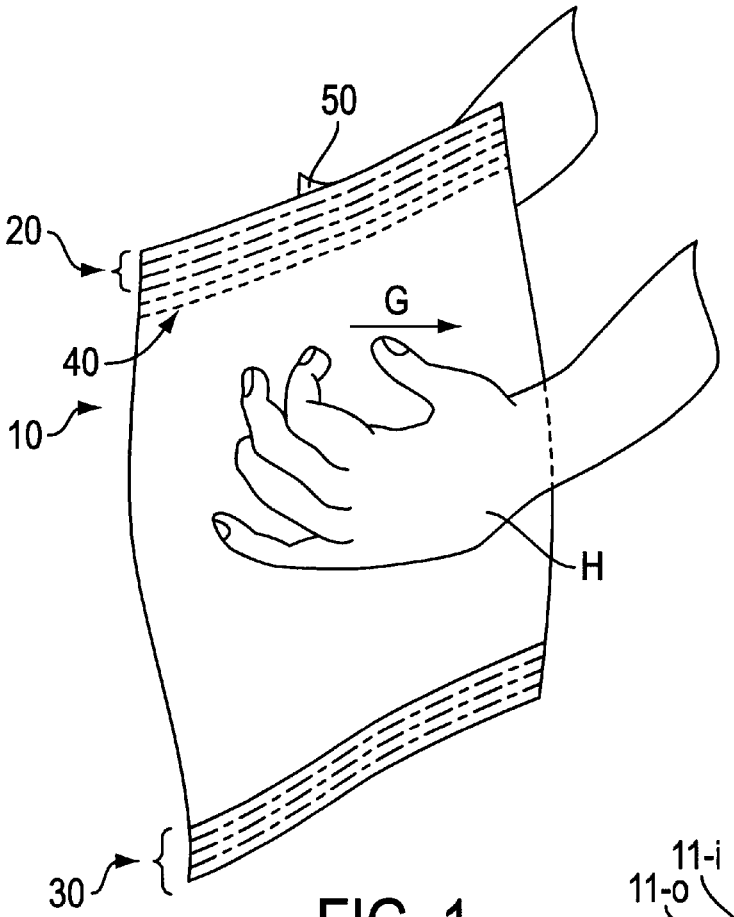
FIG. 1 is a perspective view of a consumer grasping a package according to the preferred embodiments of present invention.

FIG. 1 shows a flexible package 10 according to a preferred embodiment having a top seal 20, a bottom seal 30, a re-closable zipper 40 (shown in dashed lines) proximate the top seal 20, and a vertical back seal 50. Although the back seal 50 is illustrated as a flange extending from the middle of one of the walls 11 or 12 (i.e., formed by attaching an interior surface of the tube to an opposite interior surface of the tube), the back seal could also be flush with the package material (i.e., formed by attaching an interior surface of the tube to an opposite outer surface of the tube to overlap the sides). In addition, the back seal 50 could also be formed at another location. In addition, various other embodiments could include multiple lengthwise seals or even no lengthwise seal such as if the tube is extruded.

Figure 2:
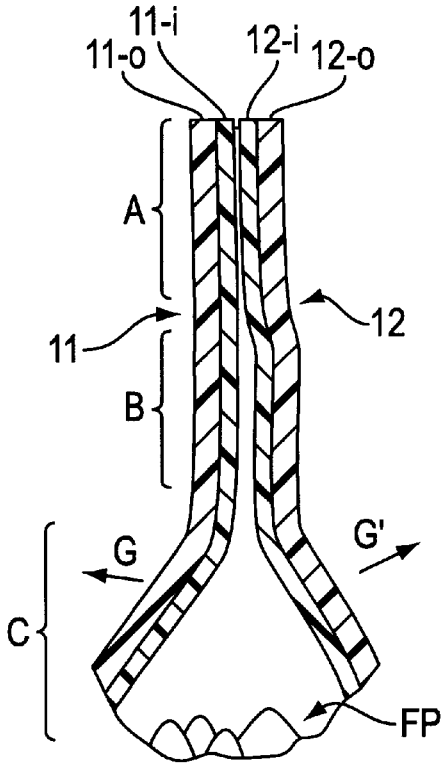
FIG. 2 is cross-sectional view of a top end of a package according to a preferred embodiment of the present invention.

As shown in FIG. 2, the package 10 includes a first wall 11 and a second wall 12. The top seal 20 is formed between the first and second walls 11 and 12 in a region A. The zipper 40 (not shown in FIG. 2) is accommodated in a region B between the walls. Food product FP is stored in a region C within the package.

As shown in FIG. 1, the package 10 is opened via a "pinch-grip" method wherein a consumer pinches the walls 11 and 12 with his or her hands H (left hand shown) and pulls generally perpendicularly outwardly in the directions G, G' (see FIGS. 1 and 2).

At least the top seal is what is defined herein as "heat/pressure/dwell formed." The terminology heat/pressure/dwell formed is defined herein as encompassing seals that are made between two adjacent walls (e.g., opposite walls of a tube of film) by applying heat and/or pressure (e.g., between sealing jaws) for a given dwell period. The seal is most preferably a de-laminating seal. Although less preferred, the seal can be 1) a cohesive seal, 2) an adhesive seal formed by heat/pressure/dwell, 3) a cold seal formed by pressure and dwell only, or 4) any other known heat/pressure/dwell seal.

The top seal 20 is preferably a de-laminating seal wherein one or both of the inner layers 11*i* and/or 12*i* de-laminate from outer layers 11*o* and/or 12*o*. In this regard, the inner layers 11*i* and 12*i* of the first and second sidewalls are sealed together (e.g., via heat and/or pressure) and this seal is broken without tearing the outer layers 11*o* and 12*o*. Except for the de-laminated portions of the respective inner layers 11*i* and/or 12*i*, the structure of the package, as seen from the outside, remains intact. Although two layers are shown, the illustrated inner and/or outer layers can each include one or more layers.

In the preferred embodiment having a de-laminating seal, the walls of the packages 10 are preferably made with multi-layered plastic materials. In one exemplary embodiment, the package can include a) an outer polypropylene layer, b) a middle polyethylene layer and c) an interior polypropylene layer. It should be apparent to those in the art that a variety of plastic and elastomeric materials can be used, including common additives. In preferred embodiments, the materials for the sidewalls 11 and 12 of the package are selected from materials disclosed in U.S. Pat. No. 5,689,935 (assigned to the present assignee), the entire disclosure of which is also incorporated herein by reference.

The package material is also preferably a clear material having an acceptable clarity to view the contents (e.g., non-cloudy). Zippered packages having cut or severed tops are not easily made clear because films for making such packages typically require properties (e.g., additives) that can inhibit clarity.

Figure 10:
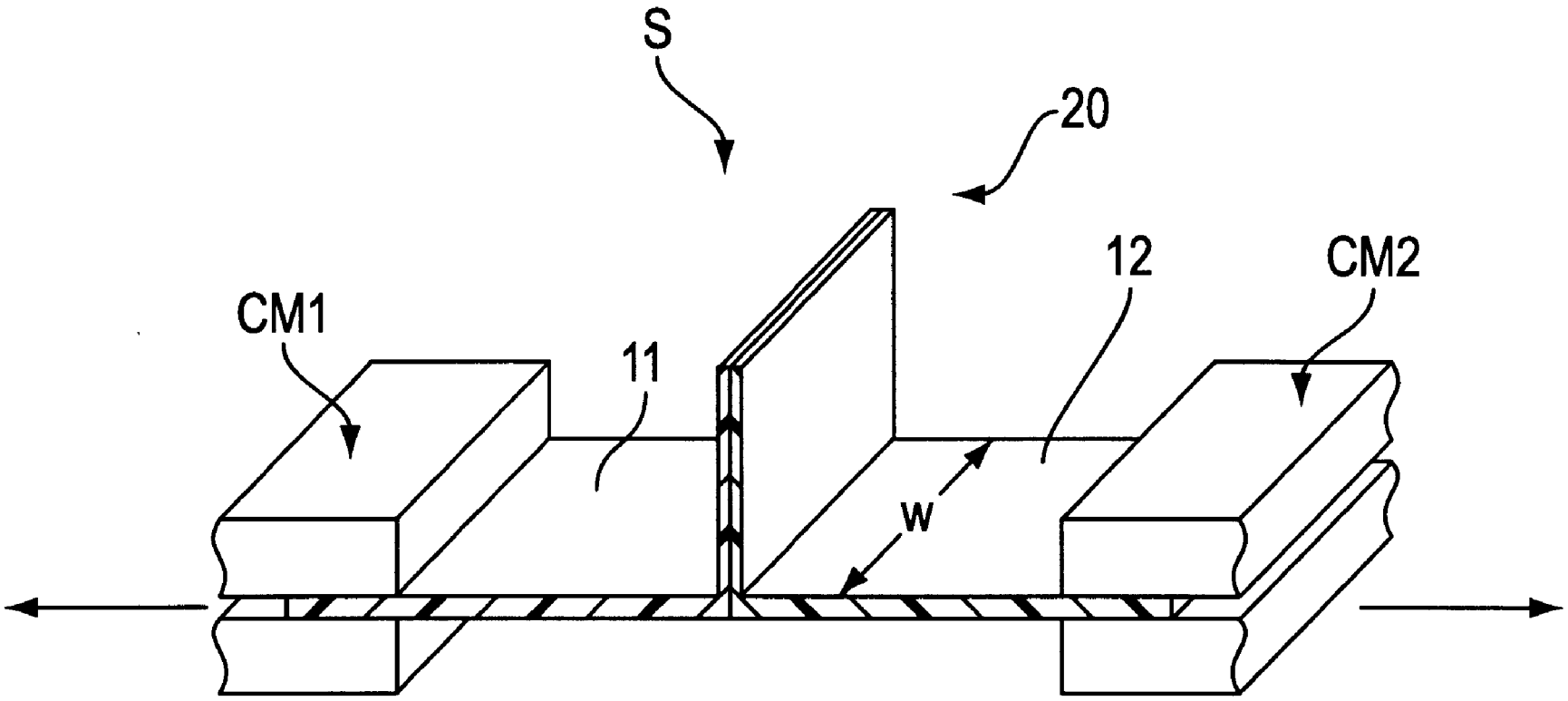
FIG. 10 is an elevational view of an exemplary strength testing apparatus.

The seal 20 preferably opens, e.g., de-laminates, upon the application of a force of less than about 3 lbs per linear inch, and more preferably of about 1 to 2 lbs per linear inch, the opening force being in the direction of the arrows G, G' shown in FIGS. 1 and 2. In less preferred embodiments, however, a larger opening force could be required. A preferred method of testing the seal strength or required opening force includes, as shown in FIG. 10: cutting a strip S having a width of about 1 inch from a top of the package 10; placing the strip S within known force testing equipment, such as equipment made by Instron Corp., having two opposite clamping members CM1 and CM2 that evenly clamp the ends of the cut-out portions of the walls 11 and 12 between upper and lower clamping members; and moving the clamping members slowly outwardly as shown by arrows in FIG. 10, such as at a rate of about 5 inches/minute. Under such conditions, the 1 inch wide portion of the seal 20 preferably opens upon the application of a force of less than 3 lbs, and more preferably between about 1 to 2 lbs. Although the seal strengths have been discussed with reference to delaminating seals, other seals 20 encompassed by the present invention are also preferably openable within the above-noted ranges of applied forces.

According to the present invention, the package is opened by pinch gripping the sides below the top seal and pulling outward. In this manner, the top seal is opened in a direction away from the product FP inside the package (i.e., opening from the product side outward). This allows the package to be opened in a consumer-friendly manner. Moreover, if a de-laminating seal were opened from above the top seal down toward the product (i.e., opening from the consumer side), the film de-lamination could continue well into the product area and undesirably strip the zipper from the package material.

The zipper 40 is attached to the package in a manner to remain engaged under a force sufficient to "pinch-grip open" the top seal. For example, in the most preferred embodiments using a de-laminating top seal, the zipper 40 is constructed so that the inner layers 11*i* and 12*i* do not de-laminate under the zipper when the package is opened—e.g., during "pinch-grip opening" of the package. Where the inner layers 11*i* and 12*i* can de-laminate, placement of a zipper 40 in a package 10 with de-laminating walls 11 and 12 presents difficulties.

The amount of force required to open the zipper 40 from either the consumer side or from the product side can be adjusted by varying the configuration of the male and female engagement members in a known manner. See e.g. U.S. Pat. No. 5,558,613, the disclosure of which is incorporated herein by reference. The '613 patent indicates that "[i]n general, the profiles must be such as to provide relatively high resistance to opening from inside the package while rendering the package relatively easy to open from the outside." In the present invention, however, the force required to open the zipper from inside the package is preferably reduced, preferably about equal to or less than the force required to open the zipper from outside the package. In one embodiment, for example, the zipper 40 opens from the inside by a force of less than about 2½ lbs per linear inch, preferably about 1½ to 2 lbs per linear inch (roughly 700–900 grams). The method shown in FIG. 10 is also a preferred method for measuring this zipper opening force, measuring for example a 1 inch wide section of the zipper.

Preferably, after the zipper is at least partially disengaged, the force required to continue disengagement of the engagement members is minimal or is greatly reduced. The maximum force required during the entire pinch-grip opening step can thus be minimized, if desired, since the peak of the force required to open the zipper can precede that required to open the top seal during pinch-grip opening. As some examples, this maximum force could be maintained under 3.5 lbs/inch, or even under 3 lbs/inch, or less. In addition, in cases where the force required to disengage the zipper essentially entirely precedes the force required to open the top seal during pinch grip opening, the maximum opening force could essentially be the force required to disengage the zipper or to open the top seal.

In the more preferred embodiments, the food product in the package is light-weight so that the risk of inadvertent opening from the product side outward (e.g., when the package is handled upside down) is reduced.

Figure 3:
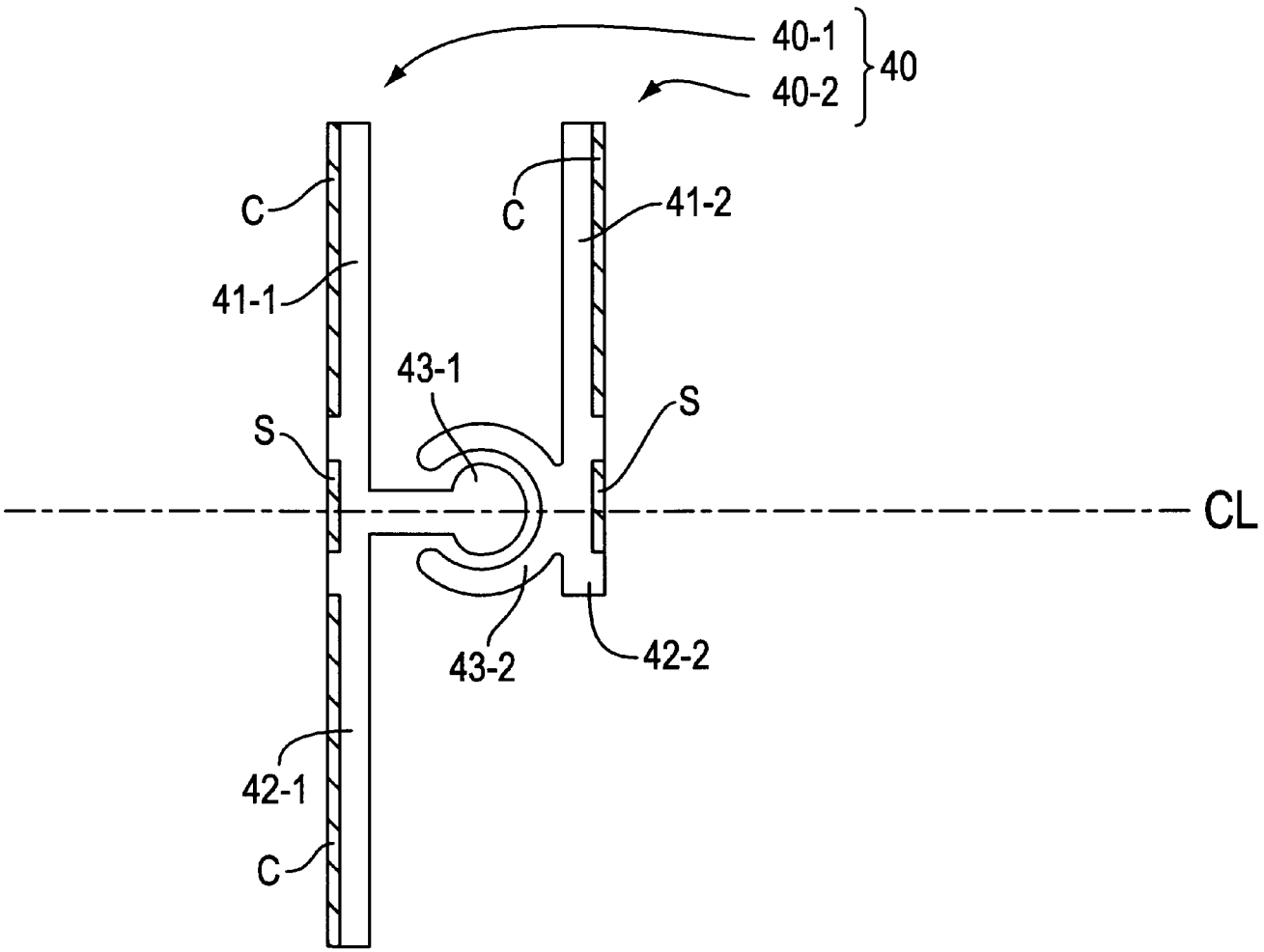
FIG. 3 is a cross-sectional view of a zipper according to a preferred embodiment of the present invention.

FIG. 3 illustrates a cross-section of a zipper 40 according to one preferred embodiment of the invention. The zipper 40 includes a male member 40-1 and a female member 40-2. The male and female members are preferably extruded plastic members. The zipper can be formed in a variety of ways, but it is preferably extruded. Although any appropriate material can be used, in one exemplary embodiment the zipper can include a polyethylene material.

Preferably, the zipper includes two separate parts having finite lengths that are equal to, or slightly less than, the package width (separate fastener parts are also shown, for example, in the '017 patent). One part is attached to one side of the package and the other part is attached to the opposite side of the package. In a preferred construction, each of the two parts includes a respective engagement portion and a base portion. The engagement portions preferably include engageable protrusions. Most preferably, the protrusions include male and female protrusions.

In the illustrated embodiment, a first part 40-1 includes a base portion having a left flange 41-1 and a right flange 42-1 extending from opposite sides of a male projection 43-1. In addition, a second part 40-2 includes a base member having a left flange 41-2 and only a minimal portion 42-2 and a female socket 43-2. The male projection 43-1 is received in the female socket 43-2. Although the preferred arrangement is shown, the male and female portions can be reversed, if desired. In alternative embodiments, additional engagement portions, e.g., additional male and female portions, can also be included. However, these additional engagement portions are not needed and are also less preferred.

In one exemplary embodiment, the package 10 can be approximately 20 inches long from its top end to its bottom end. This size package can contain multiple servings of potato chips or the like; for example, it may contain about 20 ounces (about 570 grams) or about 20 servings. The package can also contain one, two, three, etc., servings or another quantity of product. In one non-limiting example: the seal 20 can be about ½ inch wide (or alternatively about ¼ inch wide, or less); the flanges 41-1, 41-2 and 42-1 can each be about ½ inch wide; the width across the male and female engagement members can be about ⅛ inch; and the seal 30 can be about ½ inch wide. Various other dimensions could also be used as would be apparent to those in the art based on this disclosure. In addition, a space or unsealed area can be located between the top seal 20 and the top of the zipper. This space can accommodate mis-alignment during placement of the zipper on the package. Preferably, this space is between about ¼ to ½ inch. A smaller distance is beneficial because it reduces the package length, and it also reduces excess material at the top of the package. Among other things, reducing the extension distance between the bottom of the engagement portions of the zipper (which delineates the top end of the interior compartment) and the topmost end of the package provides an appearance more like prior packages and without an unsightly extension (i.e., a large top flange) off the top of the package. This extension distance can thus easily be under 2 inches, and even under 1½ inches, and even as low as about 1 inch, or less. Longer extension distances can also be used.

Figure 9:
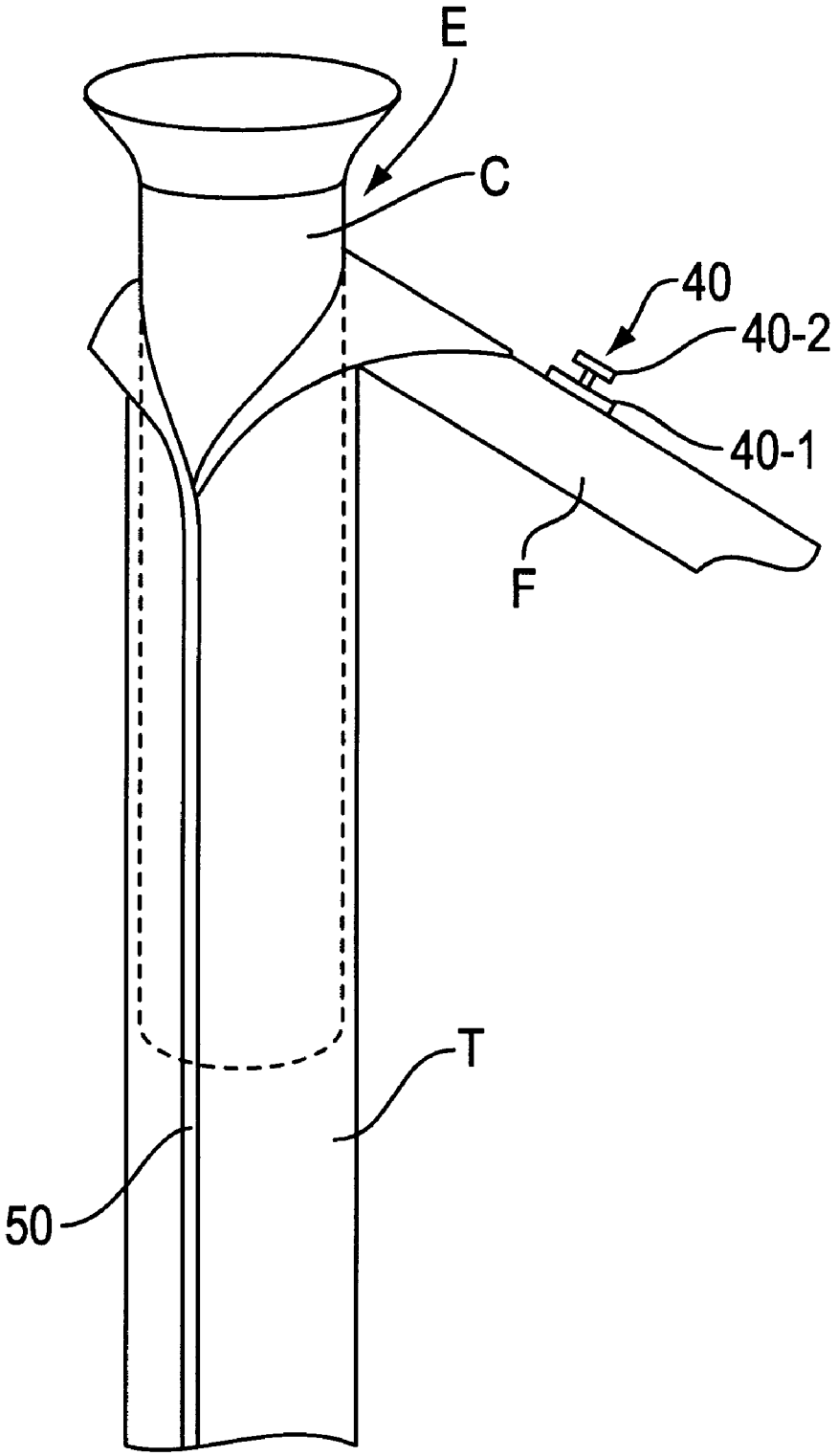
FIG. 9 is a side view of a portion of a vertical/form/fill device used in one exemplary method for making flexible packages of the present invention.

Although the package according to the present invention can be made with any known package making means, such as any horizontal or vertical filling apparatus, etc., it is preferably made in a vertical form/fill/seal apparatus. This illustrated zipper structure 40 has particular benefits in a vertical form/fill/seal apparatus of the type shown in U.S. Pat. No. 4,909,017, the entire disclosure of which is incorporated herein by reference. In applying the zipper 40 in the '017 apparatus, the minimal portion 42-2 prevents the zipper from disengaging upon downward entry into the vertical path, see point E in FIG. 9. Preferably, as discussed in the '017 patent and as shown in FIG. 9, the zipper parts 40-1 and 40-2 are initially in an interlocked condition on the film F, and the zipper is initially attached to the film F only at the base of the member 40-1.

In the illustrated embodiments, sealant layers C are formed on a rear side of each of a) the left flange 41-1, b) the right flange 42-1, and c) the left flange 41-2 to attach the zipper parts to the film. The sealant layers C are preferably co-extruded with the male and female sections 40-1 and 40-2, and are preferably made of any known sealant material to adhere to the inner layers 11*i* and 12*i* of the package 10 upon the application of pressure and/or heat.

Central sections S behind the socket 43-2 and the projection 43-1 are preferably provided with a sealant material like that of the sealant layers C. Preferably, such sealant is located in the section S of the part 40-2. It is not as necessary in all embodiments, however, to have such sealant in the section S of the part 40-1. Providing such sealant in section S of the part 40-2 ensures that separating forces during pinch-grip opening are applied more along the central axis CL of the engagement members. This feature is very beneficial when a minimal portion 42-2 is used. Without sealant applied at this location, shear and other forces during opening can result in, for example, de-lamination, stripping of the zipper seal from the film wall, etc. Each of the sealant layers S and C (when used) are preferably co-extruded with the sections 40-1 and 40-2.

With the zipper shown in FIG. 3, the sealant layers C on the left and right extensions 41-1 and 42-1 can be sufficient to maintain the section 40-1 attached to the inner layer 11*i* or 12*i* of the package 10. However, the member 40-2 preferably has its section S formed with a sealant material. In an alternative preferred embodiment, the entire rear side of the member 40-2 can be modified to contain such a sealant material. Similarly, the entire rear side of the member 40-1 can also be modified to contain such a sealant.

Figure 4:
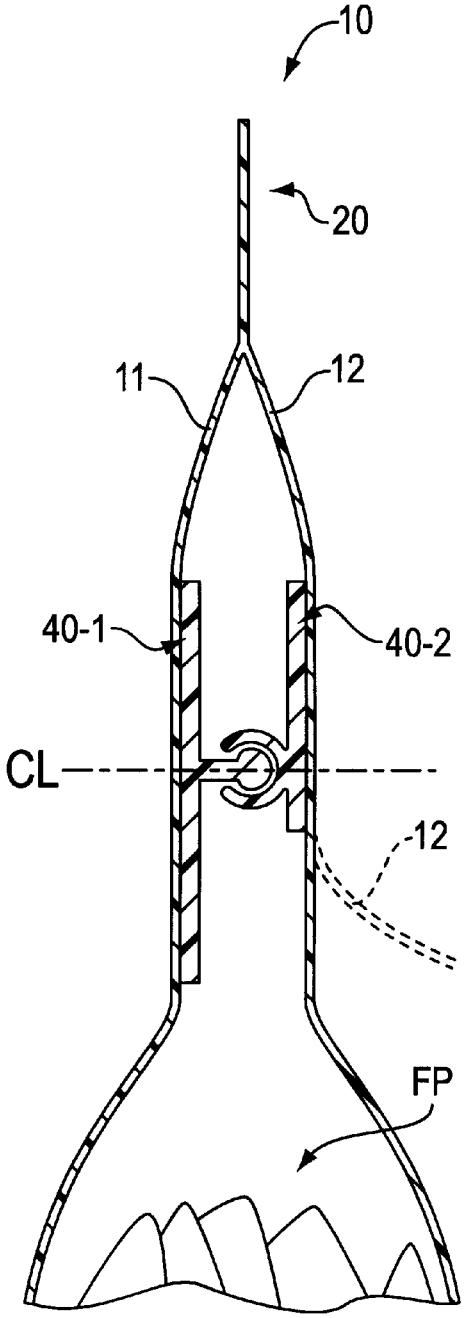
FIG. 4 is a cross-sectional view of the zipper shown in FIG. 3 inside a package according to a preferred embodiment of the invention.

As shown in FIG. 4, the left flanges 41-1 and 41-2 extend upward while the right flange 42-1 and the minimal portion 42-2 extend downward. Thus, one of the sides 40-1 or 40-2 has a shortened section (portion 42-2) extending into the package. As noted, this shortened section facilitates proper operation in a vertical form/fill/seal machine of the type disclosed in U.S. Pat. No. 4,909,017. Without the sealant material behind the engagement portion (e.g., in the region S) of the member 40-2, outward movement of the wall 12 (see dashed lines in FIG. 4) can potentially cause shear and other forces sufficient to tear the member 40-2 from the inner layer 12*i* upon "pinch-grip opening" from the product side.

Although in the preferred embodiment shown the member 40-2 with the minimal portion 42-2 has the female socket 43-2, the female socket 43-2 and the male projection 43-1 can be reversed so that the male projection is on the member having the minimal portion.

The present invention most preferably provides a four point sealant attachment, wherein sealant is applied at opposite sides of a centerline CL through the projection 43-1 and the socket 43-2 on each of the members 40-1 and 40-2, even where one of the members 40-1 and 40-2 includes a minimal portion 42-2. In addition, the present invention also provides a four point sealant attachment, wherein a zipper part having a minimal portion 42-2 includes sealant at a location directly behind its engagement member and over the centerline CL.

Figure 5:
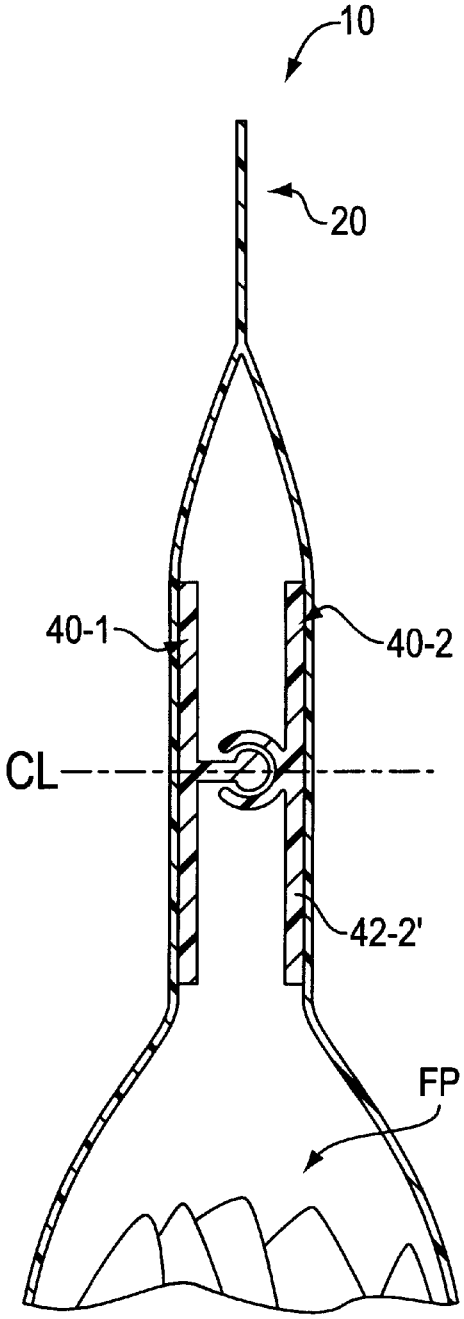
FIG. 5 is a cross-sectional view of a modified zipper inside a package according to another embodiment of the invention.

In an alternative embodiment shown in FIG. 5, an extension 42-2' is provided on the member 40-2. The extension 42-2' helps to reduce shearing, etc., because a sealant layer can be applied behind the extension 42-2' to attach to the package 10. In this alternative, sealant portion S on the member 40-2 can also be eliminated. As noted above, however, this alternative is not desirable for use in vertical form/fill/seal apparatuses of the type shown in, for example, U.S. Pat. No. 4,909,017, but may be desirable for use in horizontal form/fill/seal apparatuses or in other package making devices. In less preferred variations of the embodiments shown in FIGS. 3 and 5, the sealant can be located only behind the portions 41-1 and 41-2 if the zipper to material bond is strong enough to keep the zipper from separating from the package even without attachment between the zipper and the package at other areas. In other less preferred embodiments, one or more of the extensions 41-1, 42-1, 41-2 and/or 42-2' can be eliminated as long as the zipper to package material bond, e.g., behind the members 43-1 and 43-2, is strong enough without such portions.

Figure 6:
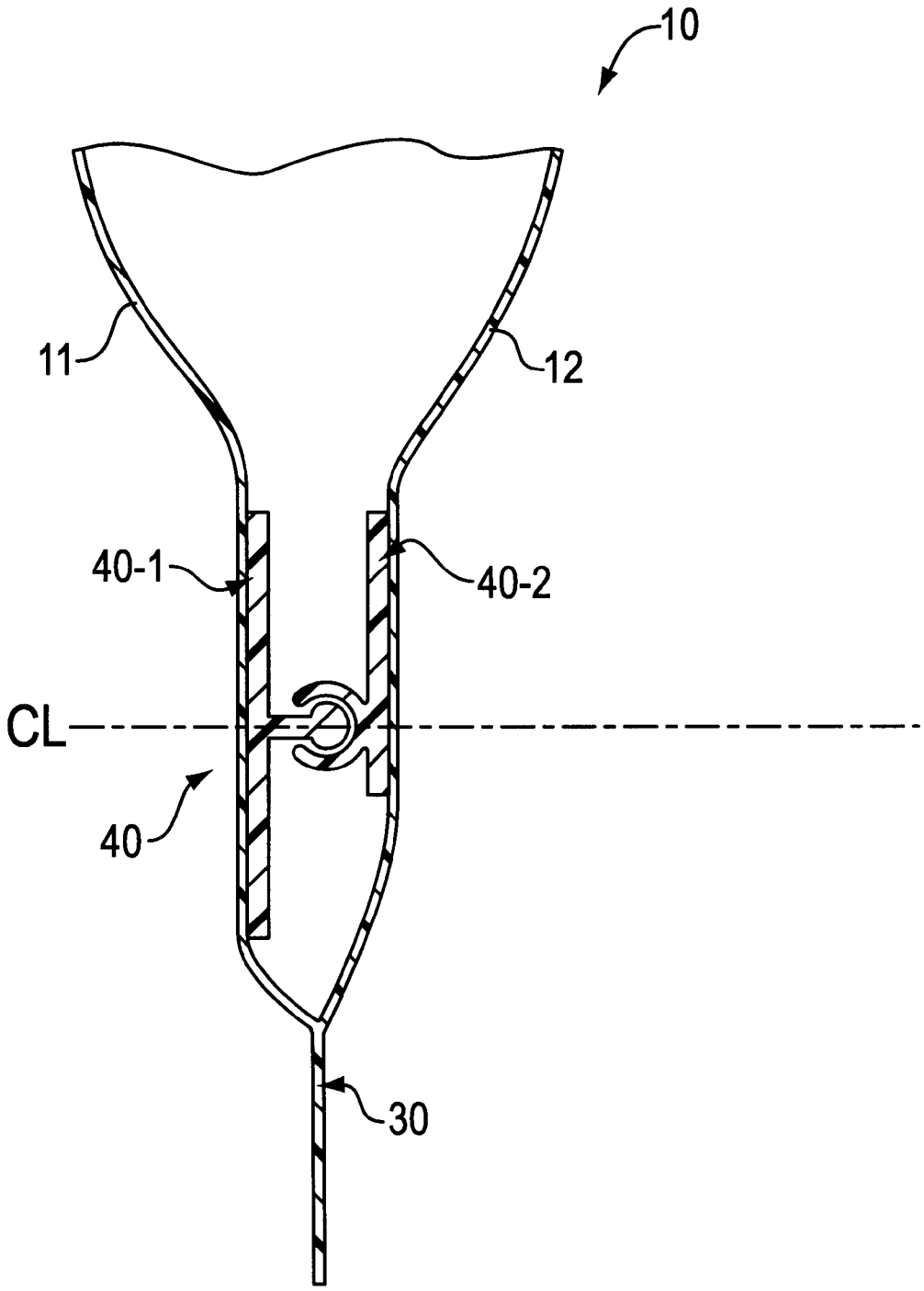
FIG. 6 is a cross-sectional view of a modified zipper inside a package according to another embodiment of the invention.
Figure 8:
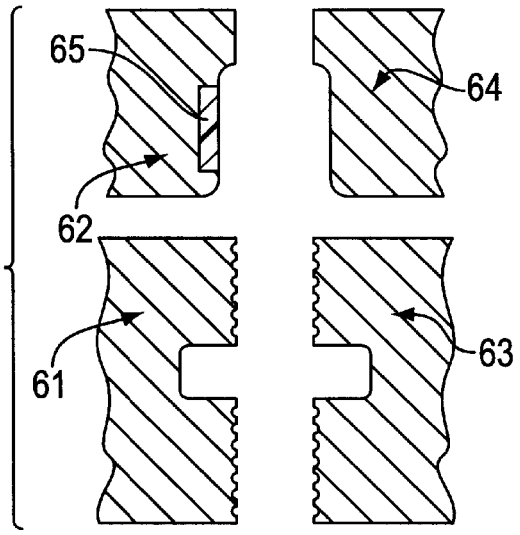
FIG. 8 is a cross-sectional view of a modified construction of the sealing head assembly for manufacturing packages like that shown in FIG. 6.

FIG. 6 shows another embodiment of the invention wherein the zipper is located in an inverted state within the flexible package. The embodiment shown in FIG. 6 is particularly advantageous in vertical form/fill/seal apparatuses. In this regard, the package is formed and filled in generally the conventional manner of vertical form/fill/seal devices. In this embodiment, however, the zipper 40 is placed adjacent the bottom seal 30 as shown, and preferably the graphics or printing on the film material is also inverted so that the bottom seal 30 is actually at the top end of the flexible packages that are formed. The zipper is first sealed to the flexible package, and product is then delivered into the vertical tube to fill the flexible package. The minimal portion 42-2 of the zipper 40 thus extends towards the top of the flexible package. This embodiment has certain advantages during the manufacture of the packages. For instance, this embodiment can facilitate "stripping" ("stripping" is a well known step in vertical form/fill/seal apparatuses that includes using "stripper bars" that initially contact the vertical tube to move contents towards the bottom of the package before forming the top seal) by re-locating the zipper 40 proximate the bottom seal 30. As shown in FIG. 8 (discussed below), the structure in FIG. 6 enables the zipper sealing jaws to be located above the sealing jaws for the top and bottom seals 20 and 30.

Figure 7:
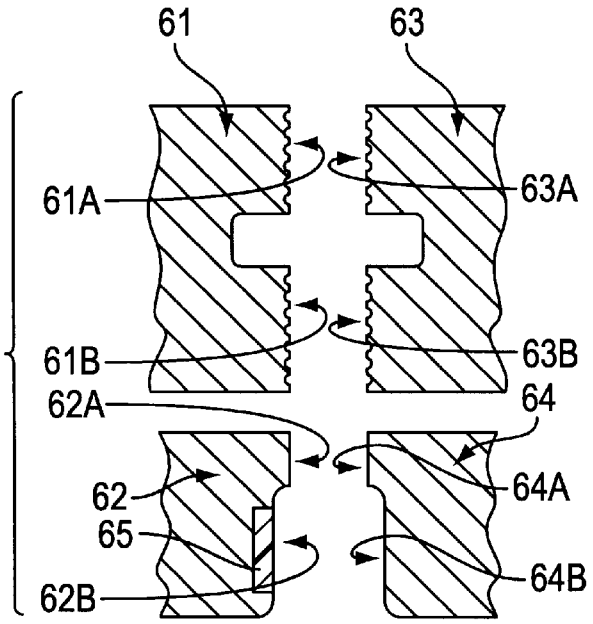
FIG. 7 is a cross-sectional view of one preferred construction of a sealing head assembly for manufacturing the packages.

FIG. 7 shows a preferred embodiment of the sealing jaws, or sealing blocks, that form the top and bottom seals 20 and 30 and that seal the zipper 40 to the package material. The sealing blocks 61 and 63 are used to form the upper and lower seals 20 and 30, and the sealing blocks 62 and 64 are used to seal the zipper 40 to the packaging material. Preferably, the blocks 61 and 62 are mounted to move together, and the blocks 63 and 64 are mounted to move together. More specifically: profiles 61A and 63A form a bottom seal 30 of an upper package; profiles 61B and 63B form the top seal 20 of a lower package; profiles 62A and 64A seal the zipper portions 41-1 and 41-2 to the flexible package material; and recessed profiles 62B and 64B seal the zipper in the region of the engagement members 43-2 and 43-1 to the flexible package material. As shown in FIG. 7, in order to more vigorously seal the package walls 11 and 12 to the zipper 40, the profile 62B can include a resilient portion 65, e.g., made with rubber such as for example a silicone rubber, to enable a greater amount of pressure to be applied to the location of the zipper proximate the engagement members (i.e., proximate the male projection 43-1 and the female socket 43-2) without damaging such portions, to enhance sealing capability with the package material. For example, applying rubber at the male side of the embodiment shown in FIG. 4 facilitates applying back-pressure at the female side, so that the female side (having the minimal portion 42-2) can have a greater pressure applied to ensure engagement of the sealant behind central section S behind the socket 43-2 to the package film material. In cases where the portion 65 is not made of rubber, the region therein can be integral with the block, e.g., metal. In such cases, the zipper is preferably constructed to absorb pressure to avoid damage when back pressure is applied.

As discussed, FIG. 8 shows a modified embodiment of the sealing blocks for manufacturing a flexible package as shown in FIG. 6. The features in FIG. 8 are like that shown in FIG. 7, except that the member 61 is mounted below the member 62 and the member 63 is mounted below the member 64. In this manner, when the jaws 61 and 63 are brought towards one another in the operation of the device, the zipper should not interfere with the motion of the jaws, stripping should be facilitated, such as with stripper bars mounted immediately below the jaws 61 and 63, etc.

While the present invention has been shown and described with reference to preferred embodiments presently contemplated as best modes for carrying out the invention, it is understood that various changes may be made in adapting the invention to different embodiments without departing from the broader inventive concepts disclosed herein and comprehended by the claims which follow.

What is claimed is:

1. A method of opening and re-closing a flexible package containing a food product, comprising the steps of:

1) providing in combination:
   a) a flexible package having
      a elastomeric front wall and an elastomeric rear wall;
      said front wall and said rear wall being sealed together at a top seal;
      a zipper having first and second zipper parts;
      said first zipper part attached to an inside surface of said front wall and having a first engagement member facing said rear wall;
      said second zipper part attached to an inside surface of said rear wall and having a second engagement member facing said front wall;
      said first and second engagement members being engaged together;
      said top seal and said first and second engagement members being pinch-grip openable under a pinch-grip pulling force applied to said front and rear walls below said engagement members;
      said front and rear walls having a sufficient strength to resist tearing and deformation under the application of said pinch-grip pulling force during pinch-grip opening; and
   b) a food product stored inside said package below said first and second engagement members;
2) pinch-grip opening said package by manually pulling with a force of at least said pinch-grip pulling force opposite sides of said package below said zipper to open both said zipper, by disengaging said first and second engagement members, and said top seal from the product side outward in a single pinch-grip opening step;
3) removing a portion of said food product from said package;
4) re-closing said package by manually re-engaging said first and second engagement members.

2. The method of claim 1, wherein during said single step of pinch-grip opening, said zipper is at least partially disengaged before said top seal begins to open.

3. The method of claim 2, wherein after said zipper is at least partially disengaged, the force required to continue disengagement of the engagement members is greatly reduced.

4. The method of claim 1, further including the step of providing said top seal with an engagement strength of less than about 3 lbs/inch, such that said top seal disengages upon a pinch-grip pulling force greater than said engagement strength.

5. The method of claim 1, further including the step of providing said top seal with an engagement strength of between about 1 to 2 lbs/inch, such that said top seal disengages upon a pinch-grip pulling force greater than said engagement strength.

6. The method of claim 1, further including the step of providing said zipper with a zipper engagement strength of less than about 2½ lbs/inch, such that said engagement portions disengage upon a pinch-grip pulling force greater than said zipper engagement strength.

7. The method of claim 4, further including the step of providing said zipper with a zipper engagement strength of less than about 2½ lbs/inch, such that said engagement portions disengage upon a pinch-grip pulling force greater than said zipper engagement strength.

8. The method of claim 1, further including the step of providing said zipper with a zipper engagement strength of between about 1½ to 2 lbs/inch, such that said engagement portions disengage upon a pinch-grip pulling force greater than said zipper engagement strength.

9. The method of claim 4, further including the step of providing said zipper with a zipper engagement strength of between about 1½ to 2 lbs/inch, such that said engagement portions disengage upon a pinch-grip pulling force greater than said zipper engagement strength.

10. The method of claim 1, further including the step of providing said top seal by heat/pressure/dwell forming said top seal.

11. The method of claim 10 wherein said heat/pressure/dwell forming includes applying heat and pressure for a dwell period.

12. The method of claim 10, wherein said heat/pressure/dwell forming includes applying pressure, without heat, for a dwell period.

13. The method of claim 1, further including the step of providing said first and second engagement members with respective interlocking protrusions.

14. The method of claim 13, wherein said step of providing said first and second engagement members with interlocking protrusions includes providing said first engagement member with a male protrusion and said second engagement member with at least one protrusion forming a female socket, said male protrusion being engaged in said female socket.

15. The method of claim 1, further including the step of providing said front and rear walls as laminated plastic walls including at least one inner sealable layer and at least one outer wall layer.

16. The method of claim 1, further including the steps of providing said first engagement member as a single male protrusion and providing said second engagement member as a single female socket, said male protrusion being engaged in said female socket.

17. The method of claim 1, further including the steps of providing said first and second zipper parts with cross-sectional shapes that are different from one another and that are separate pieces that are connected together only at said engagement members.

18. The method of claim 1, further including the step of providing said food product from the group consisting of salty, sweet or savory snack foods.

19. The method of claim 1, further including the step of providing said food product from snack food chips.

20. The combination of claim 19, further including the step of providing said snack food chips from potato or corn based chips.

21. The method of claim 1, wherein:

a) said step of providing said flexible package further includes, i) providing said front and rear walls as laminated plastic walls including at least one inner sealable layer and at least one outer wall layer, ii) providing said top seal as a seal between said inner sealable layers, said seal between said inner sealable layers being openable by de-lamination; and b) during said step of pinch-grip opening, said top seal opens by delamination.

22. The method of claim 21, wherein said delamination is carried out substantially only above said first and second zipper parts, at a consumer side of said first and second zipper parts.

23. The method of claim 1, wherein following said step of re-closing said package, said package is re-opened by either: a) again pinch-grip opening said package from below said zipper to open said zipper from the product side to the consumer side of the flexible package; or by b) opening said package from above said zipper to open said zipper from the consumer side to said product side of said flexible package.

24. The method of claim 23, wherein following said step of re-closing said package, said package is re-opened by again pinch-grip opening said package from below said zipper to open said zipper from the product side to the consumer side of the flexible package.

25. The method of claim 23, wherein following said step of re-closing said package, said package is re-opened by opening said package from above said zipper to open said zipper from the consumer side to said product side of said flexible package.

26. The method of claim 1, wherein said step of providing a food product includes providing between about 1 and 20 ounces of food product.

27. The method of claim 26, wherein said step of providing a food product includes providing about 20 ounces of food product.

28. The method of claim 1, further including the step of providing said top seal fully across a width of said package and with a vertical height of between about ¼ to ½ an inch.

29. The method of claim 1, further including the step of providing said top seal spaced above the top of said first and second zipper parts by at least about ¼ inch.

30. The method of claim 29, further including the step of providing said top seal spaced above the top of said first and second zipper parts between about ¼ to ½ inches.

31. The method of claim 1, wherein said step of providing a flexible package includes forming said flexible package with a back seal formed in a middle of said rear wall generally perpendicular to said top seal.

* * * * *